US005833252A

United States Patent [19]

Strand

[11] Patent Number: 5,833,252

[45] Date of Patent: Nov. 10, 1998

[54] LATERAL SLIDING ROLLER BOARD

[76] Inventor: Steen Strand, 3001 20th St., San Francisco, Calif. 94110

[21] Appl. No.: 717,406

[22] Filed: Sep. 20, 1996

[51] Int. Cl.[6] ..... A63C 17/04

[52] U.S. Cl. ..... 280/87.042; 16/35 D; 280/842; 280/87.041

[58] Field of Search ..... 16/35 D; 280/87.042, 280/11.19, 11.22, 11.27, 842, 87.041, 11.28

[56] References Cited

U.S. PATENT DOCUMENTS

| | | | |
|---|---|---|---|
| 605,417 | 6/1898 | Garcia | 280/271 |
| 3,827,706 | 8/1974 | Milliman | 280/11.1 BT |
| 3,924,292 | 12/1975 | Christensen | 16/35 D |
| 4,134,598 | 1/1979 | Urisaka | 280/11.22 |
| 4,212,093 | 7/1980 | Lombard | 16/35 D |
| 4,246,677 | 1/1981 | Downing et al. | 16/35 R |
| 4,280,246 | 7/1981 | Christensen | 16/35 D |
| 4,460,187 | 7/1984 | Shimizu | 280/11.1 BT |
| 4,744,576 | 5/1988 | Scollan | 280/87.04 |
| 4,805,936 | 2/1989 | Krantz | 280/842 |
| 4,886,298 | 12/1989 | Shols | 280/842 |
| 4,955,626 | 9/1990 | Smith et al. | 280/87.042 |
| 5,125,687 | 6/1992 | Hwang | 280/842 |
| 5,195,781 | 3/1993 | Osawa | 280/842 |
| 5,312,258 | 5/1994 | Giorgio | 434/253 |
| 5,372,384 | 12/1994 | Smith | 280/842 |
| 5,645,291 | 7/1997 | Ramage | 280/87.042 |

*Primary Examiner*—J. J. Swann
*Assistant Examiner*—Michael Mar
*Attorney, Agent, or Firm*—Carr & Ferrell

[57] ABSTRACT

A roller board allowing the rider to slide laterally in a manner similar to a snowboard. The roller board is comprised of a platform having four fixed wheels, and two pivoting rollers positioned along the platform's longitudinal axis. The fixed wheels function similarly to conventional skateboard trucks. The pivoting rollers rotate to align themselves with the direction of force exerted on the platform. The pivoting rollers are spring biased to align themselves with the longitudinal axis of the platform. A height differential between the two types of rollers enables the rider to transfer weight from one type of roller to the other, alternating between the carving and sliding characteristics of a snowboard.

15 Claims, 9 Drawing Sheets

LATERAL SLIDING ROLLER BOARD

BACKGROUND—FIELD OF THE INVENTION

This invention relates to skateboards, specifically to a skateboard that can transition in and out of a mode of controlled omnidirectional motion in a manner similar to the behavior of a snowboard.

BACKGROUND—DESCRIPTION OF PRIOR ART

Throughout skateboarding's history, the basic configuration of equipment has been consistent: deck, trucks, wheels. Product advances have always occurred in the context of this basic configuration. In the 1970's, urethane wheels replaced clay wheels. Later developments included kicktails, laminated wood decks for strength, precision housed bearings, and griptape and concave decks for better control. These advances have not changed the essential functionality of the board nor its motion characteristics. Meanwhile, riders have pushed the existing equipment to absurd new limits, performing tricks unimaginable several years ago.

During this period, snowboarding has arrived and is now rapidly growing in popularity. Much of this popularity results from snowboarding's seductive freedoms of movement. While these movements result from complex interactions between the board, rider and snow conditions, at least two general motion characteristics can be readily identified and these are described below. Many aspects of these motions are common to several snow and water sports such as skiing, wakeboarding and body boarding. The discussion below limits itself to snowboarding because of its direct similarities to skateboarding.

First, a snowboard rider can turn by leaning her weight towards the intended direction of travel. This effect results from the presence of sidecut and flex in the board design. As the board leans onto its edge, it turns an arc equivalent to the radius of the board's edge. If this type of turn is executed cleanly, it is referred to as "carving" and involves little or no lateral slippage of the board and rider. The rider can control the severity of the turn radius by leaning more or less weight. Skateboards have long replicated this carving behavior through the mechanical design of skateboard trucks. The truck's simple design turns the skateboard through gentle or severe turns depending on the amount of lean by the skateboarder.

The other general motion characteristic of a snowboard is its ability to offer a second direction of travel, other than the forward/backward direction. The rider can adjust her weight such that the board can slip forward, backward, sideways or some amount in each direction. Given that pure carving is limited to a forward component of motion, full omnidirectional motion can be achieved by the introduction of lateral motion. Lateral motion frequently is represented in the form of skidding, as when a car skids while turning on a slick surface. A snowboard rider can engage this second direction of travel with a velocity that is as great or greater than the forward motion component.

It should be noted that a second direction of travel has never been available to the general skateboarder. During the late 1970's and early 1980's, a number of expert skateboarders engaged in a technique referred to as "powersliding", where, through brute force alone, a rider would drive their skateboard to slide sideways. This maneuver never gained widespread popularity for several compelling reasons: (1) it was very difficult to learn and execute and thus potentially dangerous; (2) it required considerable momentum best generated only by high speeds on a steep hill; and (3) overcoming the considerable friction of the wheels required the riders to push their boards far out in front of their bodies, often necessitating the use of very heavily padded gloves to protect their hands while leaning and dragging on the passing pavement. Finally, powersliding generally required the rider to be traveling either fully sideways or not at all. All of the subtle mixtures of forward and sideways motion components, so compelling on a snowboard, were virtually impossible to engage during a powerslide.

These determined attempts by skateboarders to achieve a second direction of travel are not surprising given the novel feeling of motion that it provides. Lateral sliding enables the rider to perform a wide variety of tricks and maneuvers. A snowboard rider can rotate 180°, 360° or more, slowly or quickly, while already in motion down a hill. A rider can land a jump in any orientation—backwards, forwards, sideways or anywhere in between—and ride away successfully. In combination with carving, lateral motion lets a rider transition in and out of skidding in a highly controlled manner to maneuver skillfully down a mountain.

Because of the great appeal of snow sports, many attempts have been made to replicate them on land or pavement. Not surprisingly, almost all of the prior art represents attempts to simulate skiing. Most of these devices ignore the omnidirectional mode. U.S. Pat. Nos. 4,134,598 to Urisaka (1979) and 4,805,936 to Krantz (1989) describe wheeled skis that contain a caster in conjunction with other fixed wheels. A wheeled grass ski is described in U.S. Pat. 5,195,781 to Osawa (1993) that simulates sidecut, theoretically enabling the device to turn when leaned to the side. U.S. Pat. No. 4,744,576 to Scollan (1988) details a device that lets the skier slide back and forth, while the device itself does not move laterally. None of these examples allow true lateral sliding with respect to the terrain being traveled over.

Amongst the prior art examples attempting to offer true lateral motion, U.S. Pat. No. 5,312,258 to Giorgio (1994) uses an array of ball-type roller bearings. Unlike a ski or snowboard, this device includes no means for controlling the omnidirectional motion. Also, while perhaps functional on a constructed half pipe, it would be undermined by dirt and the rougher surface of pavement on a street or playground. U.S. Pat. No. 3,827,706 to Milliman (1974) uses a combination of pivoting casters and fixed casters where the fixed casters are slightly closer to the ground than the fixed wheels. This would potentially allow the skier to angle the ski in and out of a sliding mode. No means is provided to stabilize the casters or to smooth the transitions as weight is transferred from a pivoting caster to a fixed caster. U.S. Pat. No. 4,886,298 to Shols (1989) employs a complex twisting ski design that combines four casters with normal skateboard trucks.

Three patents in this area show the use of a biased, pivoting caster. U.S. Pat. No. 4,460,187 to Shimizu (1984) describes two skis and U.S. Pat. No. 5,125,687 to Hwang (1992) describes a single board for simulating the parallel skiing body position. Both inventions have a single caster towards the front, with an extension spring tensioning the caster to point straight ahead. These inventions do not allow lateral sliding; they do not permit the caster to rotate through 180° or 360°; they do not allow for the possibility of multiple locations of bias on the caster; and they do not permit the characteristics of the bias force to be optimized.

The skis described in U.S. Pat. No. 4,886,298 to Shols (1989) incorporate a bias via a hinge and a compliant mounting surface. As weight is applied to the ski, the caster tilts along the hinge axis, biasing the caster in the forward direction. This configuration satisfies only the ability to rotate 360° unimpeded. It does not permit more than one direction of bias; its force profile starts low and grows gradually, allowing wobbling and doing little to help the rider back into the straight ahead position; and the force profile can not be modified.

Biased casters that allow unimpeded 360° rotation and specific force profiles are described by U.S. Pat. Nos. 4,246,677 to Downing and Williams (1981) and 4,280,246 to Christensen (1981). These inventions relate to semi-automated cart delivery systems typically used in hospitals for transporting food and medication. When the carts are lifted, the pivoting casters rotate to a predetermined angle, allowing them to move through an automated system. When the casters are touching the ground, the inventions function only to lessen wheel flutter. They are not intended to augment the cart's motion and steering characteristics.

SUMMARY OF THE INVENTION

Accordingly, it is the objective of the present invention to bring a new freedom of movement to skateboarding. This freedom is best represented by the motion and balance characteristics of snowboarding. Specifically, the objects and advantages are:

(a) to provide the ability to "carve," as a conventional skateboard can, where leaning weight to one side causes the device to turn in that direction;

(b) to provide the ability to shift into a mode of omnidirectional behavior, where the device can easily travel forwards, backwards, sideways or any combination thereof;

(c) to provide the ability to transition smoothly and controllably between carving and the omnidirectional mode;

(d) to provide a user interface that simulates the balance characteristics of snowboarding and other board sports, where the omnidirectional mode is engaged when weight is relatively evenly distributed across the board and this mode can be exited by transferring significant weight to the board's edge;

(e) to provide the ability to rotate the board 1 80°, 360°, or more, repeatedly, without lifting or unweighting the board, while in motion over terrain;

(f) to provide a means such that the relative ease of entering the omnidirectional mode can be increased or decreased according to the user's preference;

(g) to provide the ability to ride on different types of terrain, including paved surfaces, grass and dirt;

(h) to provide a means for speed control; and (i) to create a device that is economical to produce and sell. Further objects and advantages of my invention will become apparent from a consideration of the drawings and ensuing description.

DETAILED DESCRIPTION OF THE PREFERRED EMBODIMENT

Figure 1:
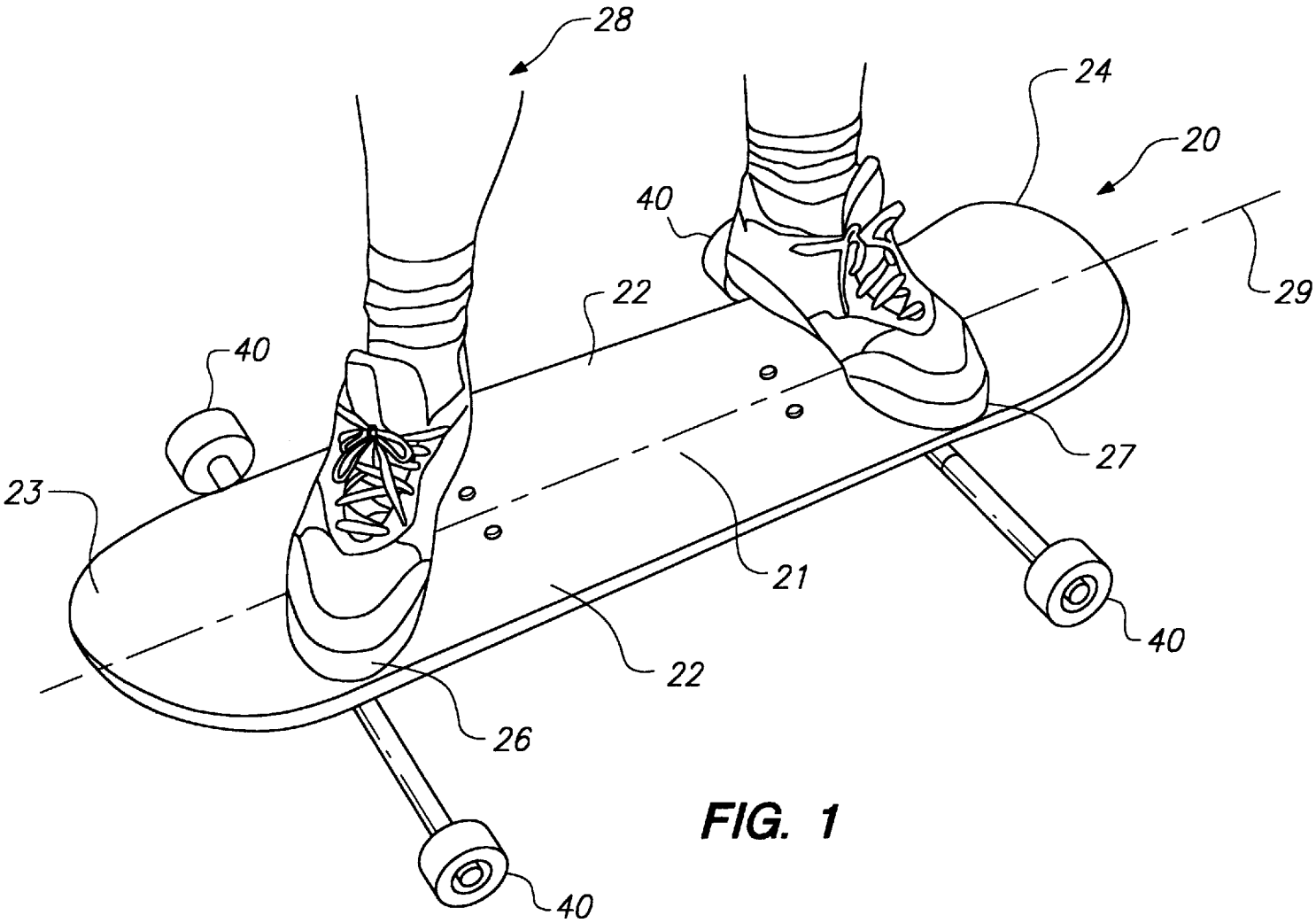
FIG. 1 is a perspective view of the roller board in use by a rider.

A typical embodiment of the present invention is shown in FIG. 1. A platform 20 has a center base 21, two sides 22, a front tip 23, and a rear tail 24. Front tip 23 is sufficiently different in shape from rear tail 24 that the user can easily distinguish one from the other. Sides 22 are roughly identical to each other. Platform 20 is wider and longer than a normal skateboard deck. Typical skateboard decks measure between 7.5" to 8.5" wide and 31" to 34" long. Platform 20 measures 10.5" wide and 40" long. As will be shown later, this additional size makes the roller board easier to ride and control.

A rider 28 positions herself on platform 20 in a stance similar to that used for snowboarding, surfing or conventional skateboarding. Rider 28 stands sideways with a rear foot 27 roughly perpendicular to a longitudinal center line 29. A front foot 26 is typically angled somewhat towards tip 23. This stance allows rider 28 to easily shift her weight onto her toes or onto her heels. Rider 28 can also move freely about the surface of platform 20, assuming different stances for different maneuvers. As with a conventional skateboard, front tip 23 and rear tail 24 angle upwards from base 21. By transferring weight to tip 23 or tail 24, rider 28 can perform numerous tricks and maneuvers where part or all of the roller board becomes elevated from the ground.

Figure 2:
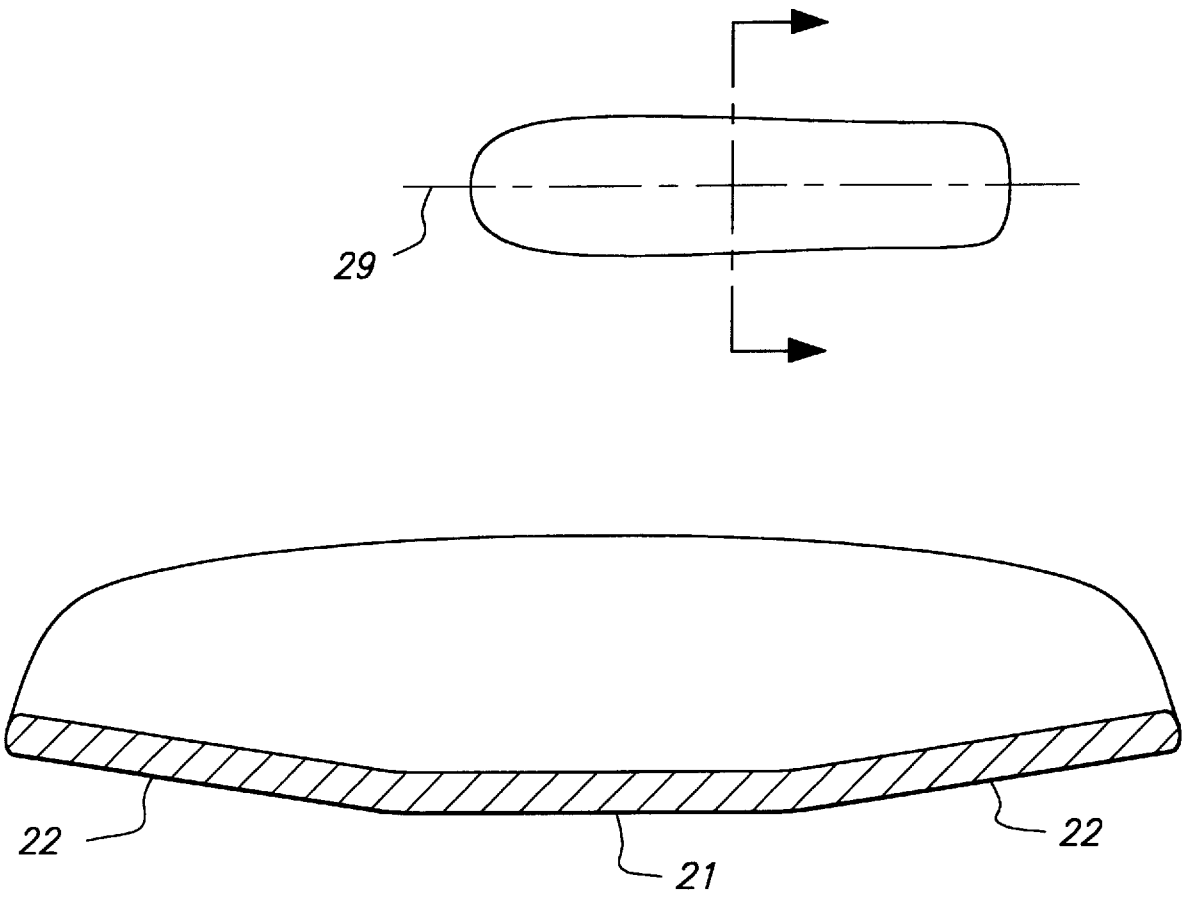
FIG. 2 is a cross sectional view of the platform of the roller board, cut perpendicular to its longitudinal axis, through the platform's center.

FIG. 2 shows a cross-section of platform 20, cut perpendicular to longitudinal center line 29. To assist rider 28 in transferring lateral and rotational force to platform 20, the shape of platform 20 is concave, with sides 22 gently angled upwards from base 21. Angled sides 22 create a surface that rider 28 can push sideways against. In addition, a high friction surface such as grip tape can be applied to the topside of platform 20. This also enhances the ability of rider 28 to apply lateral and rotational force to the roller board.

Figure 3:
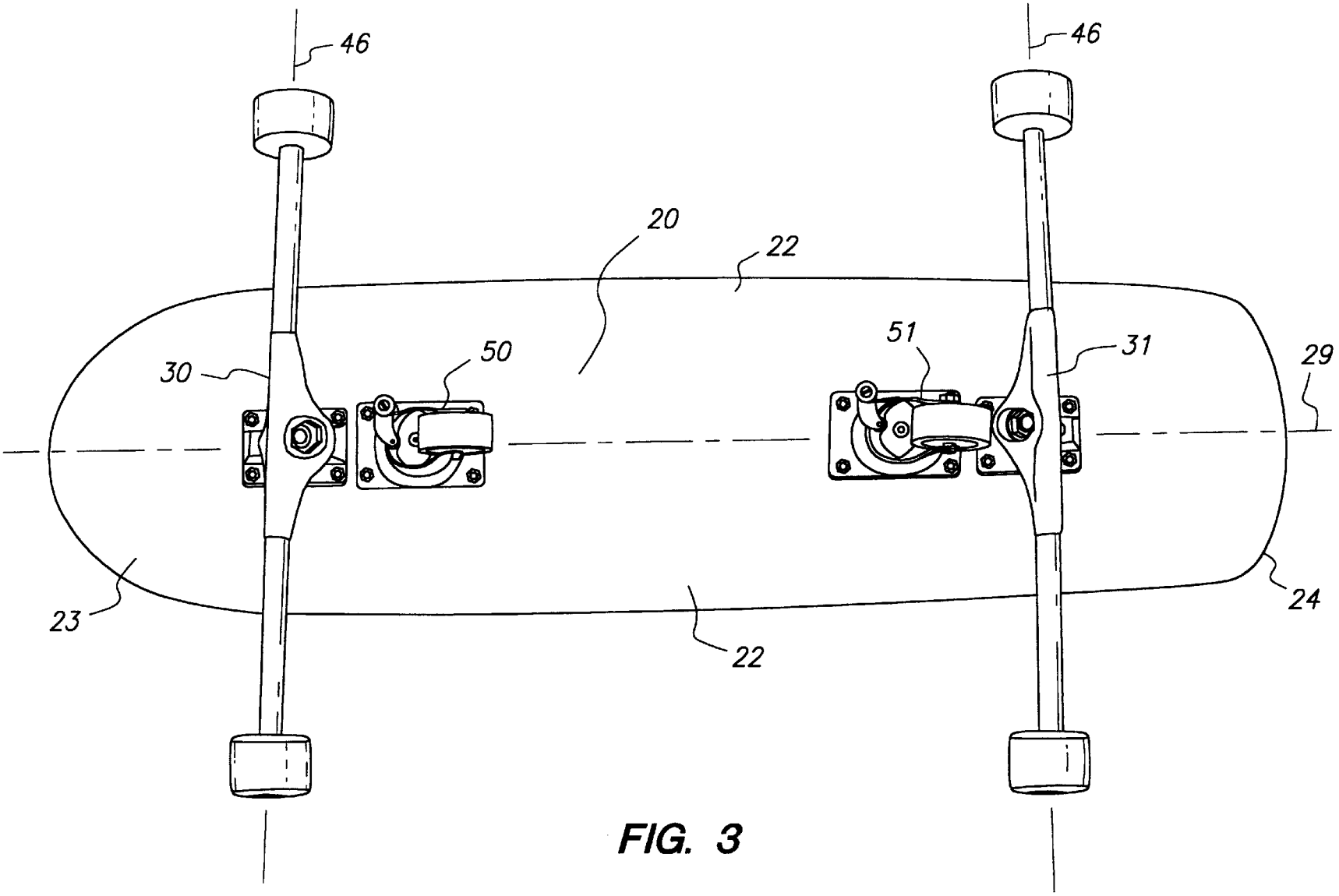
FIG. 3 is a perspective bottom view of the roller board.

As shown in FIG. 3, two basic types of mechanical components are mounted to the underside of platform 20. Fixed wheel assemblies 30, 31 are positioned along longitudinal center line 29, roughly towards tip 23 and tail 24, mirroring one another. Biased pivoting roller assemblies 50, 51 are positioned just inside of fixed wheel assemblies 30, 31, also along longitudinal center line 29. The fixed wheel assemblies 30, 31 provide a different functional characteristic and a different effect on maneuvering than do the biased pivoting roller assemblies 50, 51. Combining the assemblies 30, 31, 50, 51 together in the unique manner of this invention simulates snowboarding very effectively.

FIG. 3 also shows the considerable distance between fixed wheel assemblies 30, 31. As measured from a transverse axis 46 of fixed wheel assembly 30 to transverse axis 46 of fixed wheel assembly 31, the distance measures 28", compared to an equivalent distance of 20" on a conventional skateboard. This distance creates a much longer wheel base than found on a conventional skateboard. This longer wheel base makes the roller board more stable and easier to ride. By comparison, surf boards, snowboards and skis all become more stable as the length of their base is increased.

FIG. 3 also shows the close proximity between fixed wheel assemblies 30, 31 and biased pivoting roller assemblies 50, 5 1, respectively. Biased pivoting roller assembly 50 is positioned as close as possible to fixed wheel assembly 30 but not so close that they mechanically interfere with each other. Likewise, biased pivoting roller assembly 51 is positioned as close as possible to fixed wheel assembly 31 but not so close that they mechanically interfere with each other. Increasing the distance between biased pivoting roller assemblies 50, 51 contributes to the overall stability of the roller board in the same manner as increasing the distance between fixed wheel assemblies 30, 31.

Figure 4:
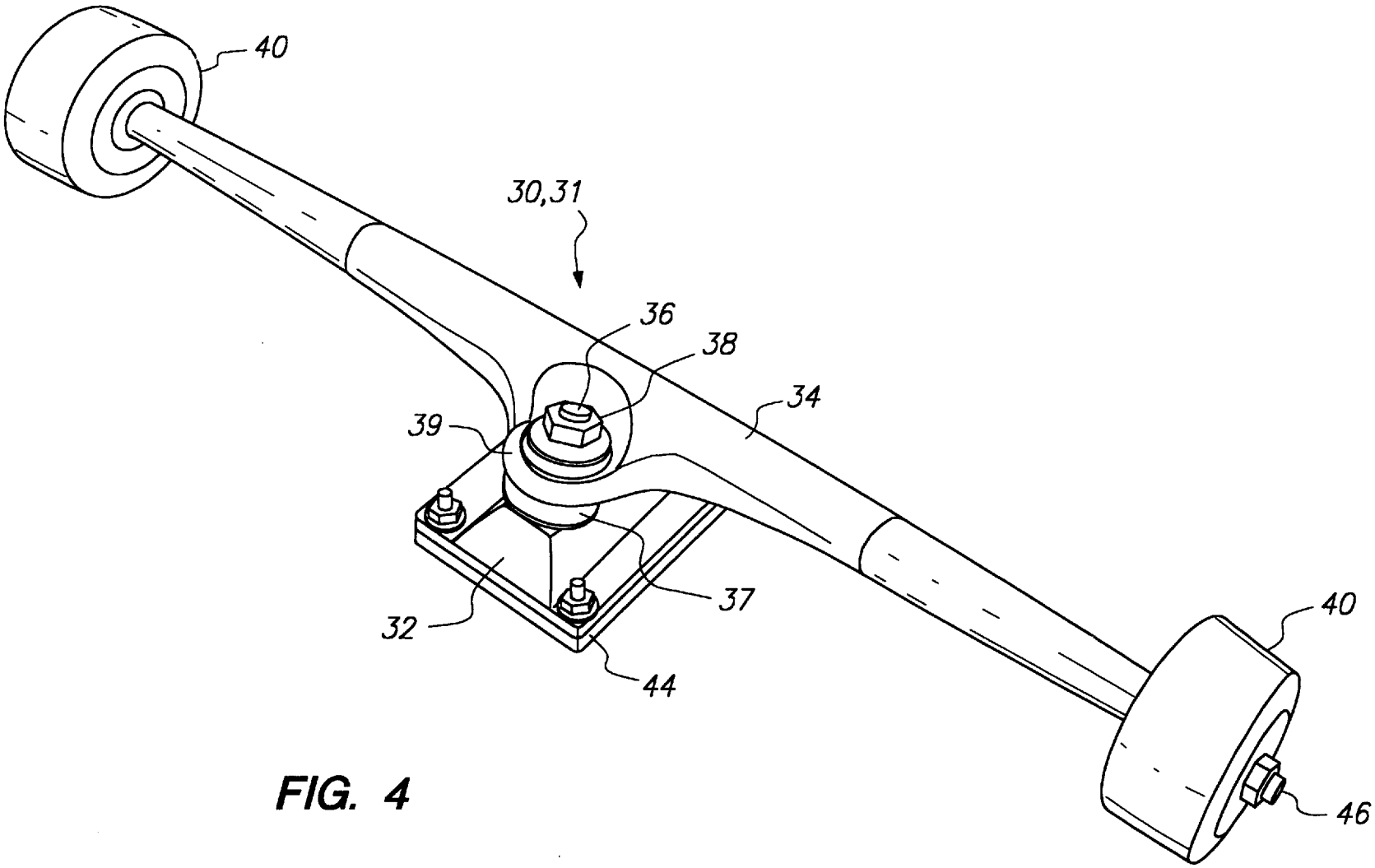
FIG. 4 is a perspective view of the fixed wheel assembly.

Referring now to FIG. 4, fixed wheel assemblies 30, 31 are similar in many respects to conventional skateboard trucks, but with unusually wide axles. At their widest dimension (along a transverse axis 46), fixed wheel assemblies 30,31 greatly 20". The widest conventional skateboard trucks measured along this same dimension are less than 10" wide. The unusual width of fixed wheel assemblies 30, 31 greatly increases the roller board's overall stability. It also greatly lessens the possibility of the roller board "catching an edge," where the roller board stops abruptly while sliding laterally. Finally, the unusual width helps give the roller board a wide range of speed control. This is explained in greater detail further on.

Still referring to FIG. 4, a fixed wheel base 32 sandwiches a height adjustment riser 44 when attached to platform 20. The assembly has an axle mount 34 with transverse axis 46 to which a fixed wheel 40 is attached. A flexible connection is made between a collar 39 attached to axle mount 34 and base 32 with a bolt 36 housed in an elastomeric sleeve 37.

Figure 5:
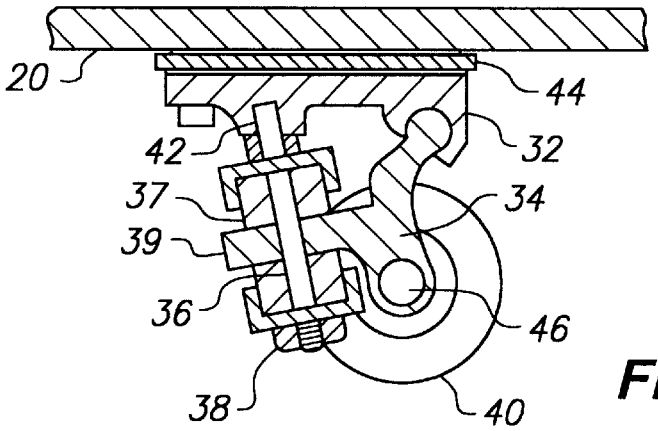
FIG. 5 is a cross sectional view of the fixed wheel assembly.

Referring now to FIG. 5, bolt 36 is held fixed by a press fit 42 into base 32 at an acute angle with respect to base 32. Fixed wheel assemblies 30, 31 provide limited pivotal movement of fixed wheels 40 when platform 20 is tilted. Because fixed wheel assemblies 30, 31 are oriented symmetrically such that collars 39 face towards the center of platform 20, this pivotal movement of fixed wheels 40 causes platform 20 to turn. Thus, when the rider leans to one side, platform 20 turns in that direction. A threaded nut 38 allows the compression of elastomeric sleeve 37 so that the force necessary for the pivotal movement can be raised or lowered.

Figure 6:
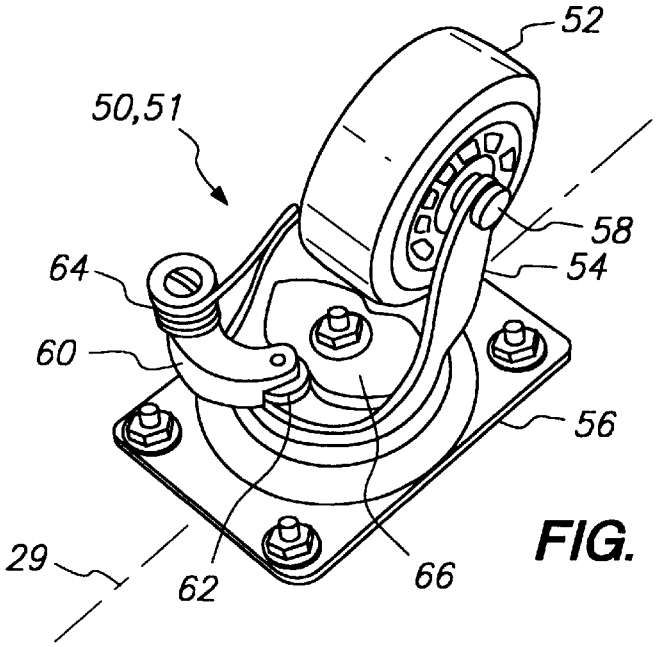
FIG. 6 is a perspective view of the biased pivoting roller assembly.

Referring now to FIG. 6, biased pivoting roller assemblies 50, 51 provide the means for omnidirectional motion. A pivoting roller 52 stays in constant contact with the ground and can rotate to align itself with the direction of force exerted on platform 20 while the user is turning or sliding. The assembly is spring biased to align itself along longitudinal center line 29 of platform 20, pointed either forward or backwards. This bias simulates the natural tracking tendency of a ski or snowboard and greatly enhances the user's control. The bias is gauged to be strong enough to add control, but not so strong that the rider is impeded from rotating platform 20 into sideways travel.

Figure 7:
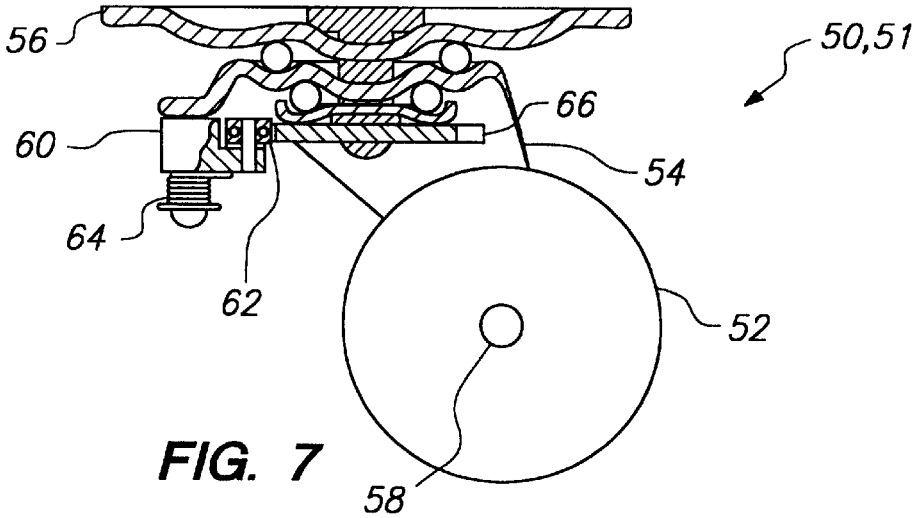
FIG. 7 is a cross sectional view of the biased pivoting roller assembly.

This spring bias is implemented as follows. Pivoting roller 52 is attached to a caster 54 and rotates around a horizontal axis 58. In turn, a base plate 56 is attached to the underside of platform 20. A cam follower 60 is pivotally attached to caster 54 and includes a torsion spring 64. Cam follower 60 includes a bearing 62 and is forced by spring 64 against a cam 66 that is fixed relative to base plate 56. This causes caster 54 to rotate to a position of least force between cam 66 and cam follower 60. By adjusting the shape of cam 66 and the spring force on cam follower 60, a variety of bias profiles can be obtained. FIG. 7 shows a cross sectional view of biased pivoting roller assemblies 50, 51.

Figure 8:
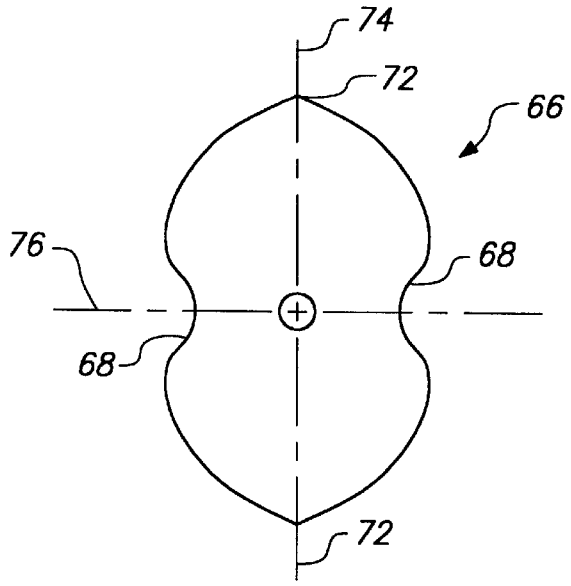
FIG. 8 is a plan view of the cam included in the biased pivoting roller assembly.

A preferred embodiment of cam 66 is shown in FIG. 8. The shape is symmetrical along a major axis 74 and a minor axis 76. Two notches 68 create positions of least resistance where a sizable threshold of force must be surpassed to allow rotation of caster 54. The radius of notch 68 corresponds to the radius of bearing 62 so that a snug, stable fit is engaged when pivoting roller assembly 50, 51 is aligned with longitudinal center line 29 of platform 20. On either side of notches 68, the radial distance to the edge of cam 66 increases as rotation continues until it reaches an apex 72. Apex 72 is gently pointed to prevent cam follower 60 from sticking at the transition from one side of cam 66 to the other. In other words, caster 54 will always be biased to return to one of two stable positions.

Figure 9:
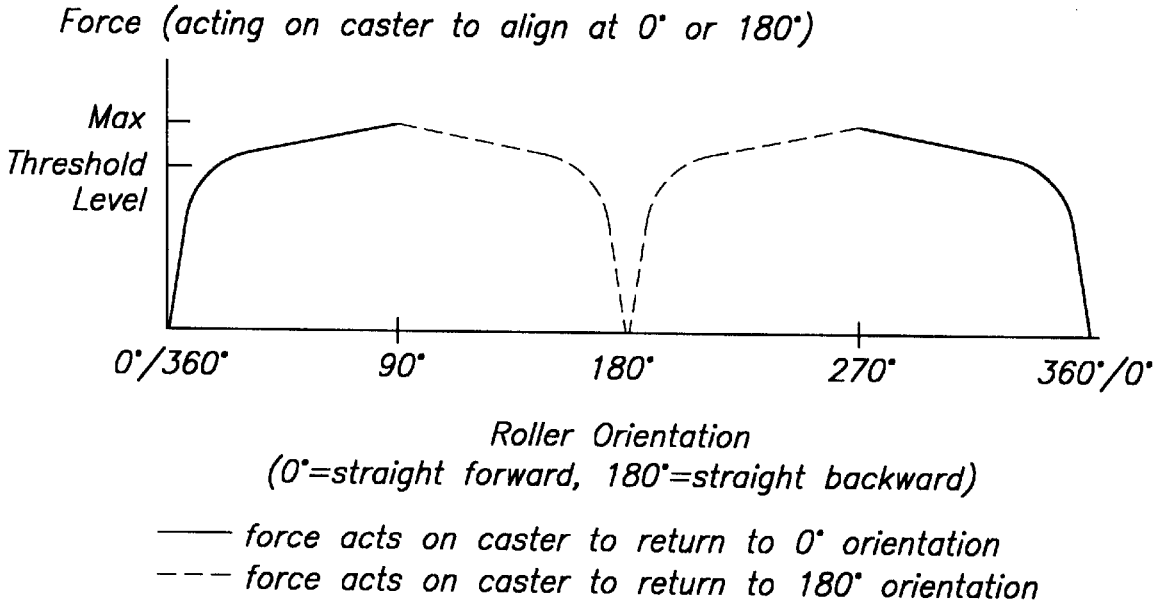
FIG. 9 is a graph showing the alignment forces acting on a pivoting roller.

FIG. 9 shows a graph of the forces acting on pivoting roller 52 via caster 54 when in different orientations. The x-axis represents the orientation of pivoting roller 52 with respect to the front of the board. The y-axis represents the amount of force acting to return the pivoting roller to the position of 0° or 180°. When aligned with the longitudinal center line 29 of platform 20, pivoting roller 52 rests in a stable position. As the orientation is rotated away from this position, force rises sharply to a "threshold level," then levels off. The use of cam 66 permits great control over the type of force being applied to caster 54. The shape of cam 66 can be modified in an infinite number of ways to change the characteristic of the bias.

The roller board succeeds because of the unique interactive effect between fixed wheel assembly 30, 31 and biased pivoting roller assembly 50, 51. Together, the assemblies 30, 31, 50, 51 allow the rider to control the amount of friction between fixed wheels 40 and the surface being traveled over, whether that surface is pavement, grass, dirt or rock. When this friction is increased, fixed wheels 40 allow the rider to carve turns. When this friction is decreased, fixed wheels 40 can slide laterally enabling the rider to engage a mode of omnidirectional motion. Friction is generally a function of force and material. While the material of fixed wheels 40 does not change, the amount of force acting on them can be varied greatly. This occurs through the unique interaction of fixed wheels 40 and pivoting rollers 52 as demonstrated in FIGS. 10–12.

Figure 10:
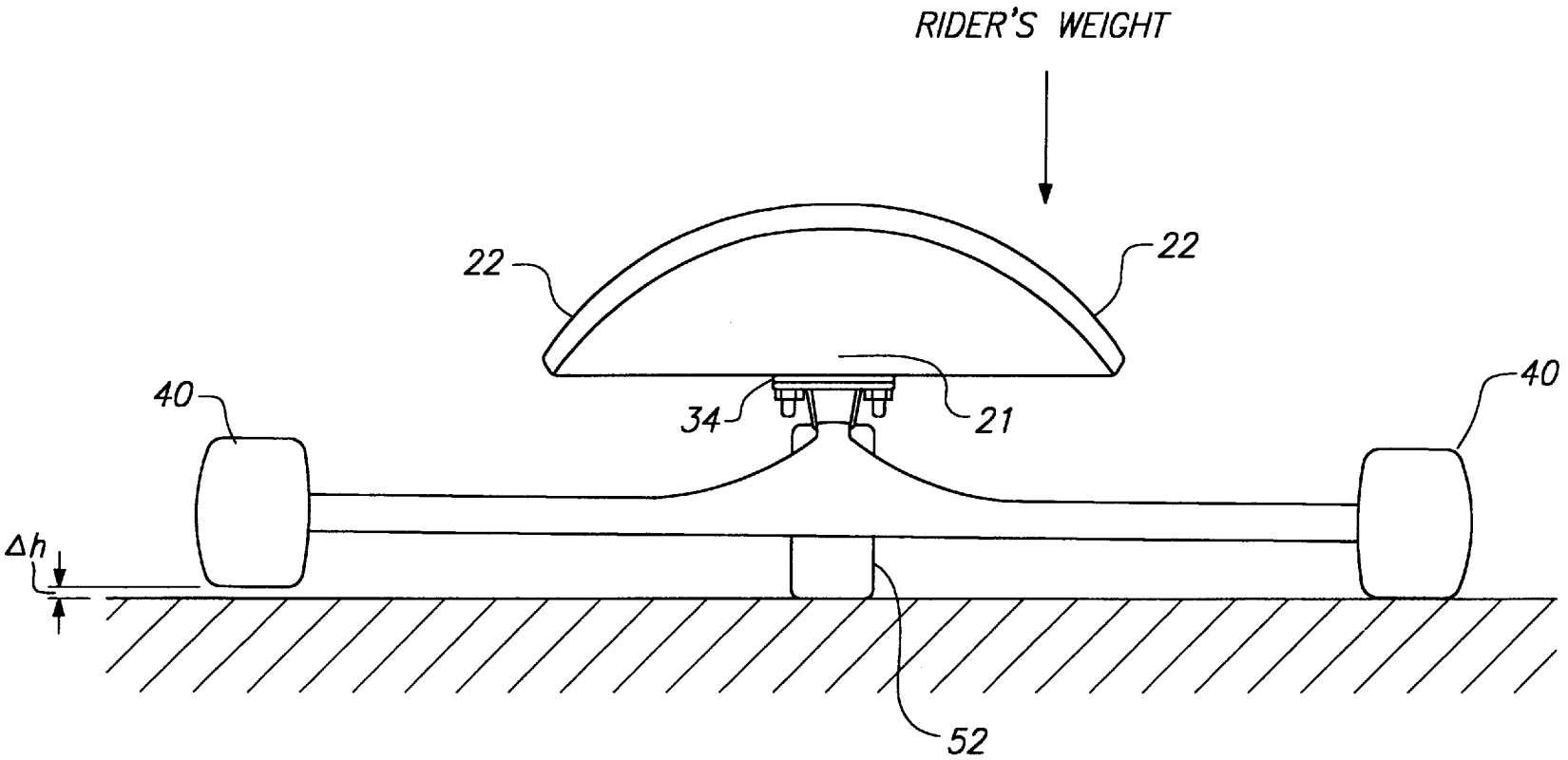
FIG. 10 is a front view of the roller board showing the relative wheel positions when the rider is leaning toward one side.

Pivoting rollers 52 extend slightly closer to the ground than fixed wheels 40. FIG. 10 shows the positions of the different rollers relative to the ground when the rider places her weight towards one edge of platform 20. In this position, sufficient force can be applied to fixed wheels 40 on one side of platform 20 to allow them to frictionally engage the ground. As a result, fixed wheels 40 prevent platform 20 from sliding sideways. They also allow the rider to carve as on a conventional skateboard. A height differential $\Delta h$ can be measured between elevated fixed wheel 40 (on one side of platform 20) and the ground. The greater the size of $\Delta h$, the easier it is for the rider to enter into a mode of omnidirectional motion. By changing the thickness of height adjustment riser 34, $\Delta h$ can be increased or decreased. The value of Ah would typically range from 1/16" (difficult to slide laterally) to ½" (easy to slide laterally).

Figure 11:
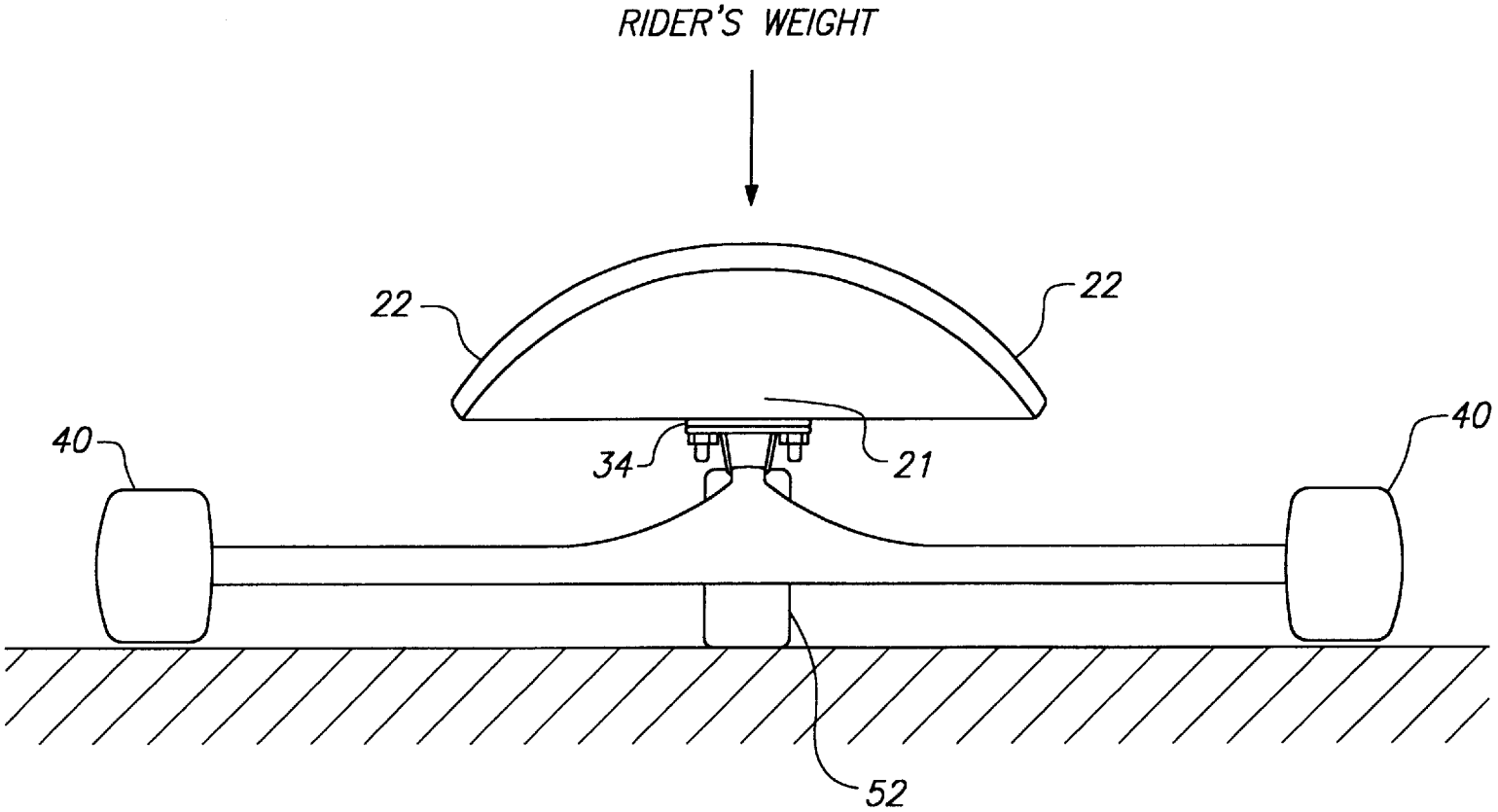
FIG. 11 is a front view of the invention showing the relative wheel positions when the rider's weight is perfectly centered over the board's longitudinal axis.

FIG. 11 shows the roller board when the rider's weight is perfectly centered over platform 20. Ideally, both fixed wheels 40 are slightly above the ground and the rider's weight rests solely on pivoting rollers 52. In this configuration, the roller board is free to travel in any direction, constrained only by the spring bias acting on pivoting rollers 52. It is important to note that entering the omnidirectional mode of travel does not depend on fixed wheels 40 being elevated from the ground. The important factor is the amount of force being applied to them. As long as the rider is generally centered over platform 20, her weight will rest predominantly on pivoting rollers 52. This reduces the friction between fixed wheels 40 and the ground to a level where the device can easily slide sideways.

Figure 12:
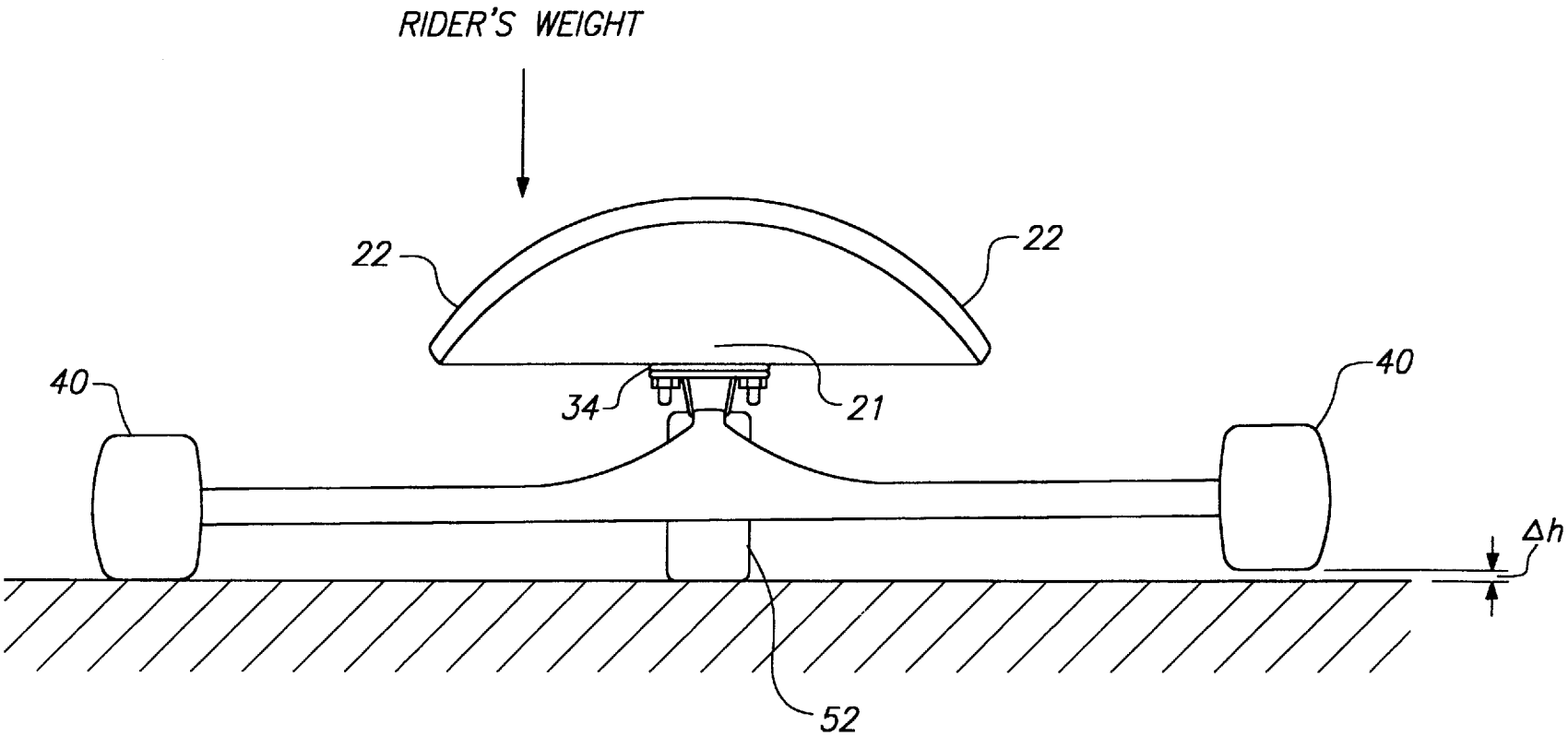
FIG. 12 is a front view of the invention showing the relative wheel positions when the rider is leaning toward the opposite side.

FIG. 12 shows the position of the various rollers as weight is shifted to the opposite side. The effect is the same as described for FIG. 10. By shifting weight from one side to another, rider 28 can use the roller board to carve without entering into a sliding mode. This behavior is equivalent to a snowboarder shifting from one edge of the snowboard to the other. While fixed wheels 40 frequently lose contact with the ground, the rider does not feel these transitions. They are cushioned by elastomeric sleeve 37 in fixed wheel assembly 30, 31.

FIGS. 10–12 help to demonstrate the value of the unusual width of fixed wheel assembly 30, 31. First, the wider the axle mount 34, the smaller the proportion of weight borne by fixed wheels 40 when the rider is roughly centered on platform 20. This minimizes friction between the fixed wheels 40 and the surface traveled over. Yet if platform 20 is also very wide, the rider can still transfer considerable weight onto fixed wheels 40 by moving to the platform's edge. A configuration of fixed wheels 40 positioned wide apart and a wide platform 20 gives the rider a smooth and controllable transition between the carving mode and the omnidirectional mode.

FIGS. 10–12 also show how the rider can implement variable speed control. When the device is traveling fully sideways with the rider's weight centered over platform 20, the travel is almost as efficient as traveling with platform 20 pointed forward. To slow down, the rider can shift her weight from base 21 to side 22. This weight transfer vastly increases the friction acting on two of fixed wheels 40, effectively slowing the board. The rider can vary the speed control by varying the amount of weight transfer.

As the rider transitions her weight on and off of fixed wheels 40, the design of biased pivoting roller assembly 50, 51 has many compelling advantages. First, the roller board engages a stable position when traveling straight forward and also when traveling straight backwards. This makes it symmetrical in performance, allowing 180° rotations, just like a real snowboard. Second, the bias force holding pivoting roller 52 aligned straight increases rapidly at first, then levels off (see FIG. 9). This bias force profile limits wobbling of pivoting roller 52 and enables the rider to easily track a straight line when desired. Yet the rider can also easily rotate the board sideways by deliberately applying the "threshold force" (see FIG. 9). Third, this bias force profile is especially effective at returning the rider to a straight ahead position after executing a slide or a rotation. As the rider brings the device close to straight ahead, there is a very subtle but reassuring feeling of it locking into place. Fourth, while the caster is stable at two positions, it is free to rotate an infinite number of times unimpeded. This is especially important as snowboarders frequently rotate successively in one direction. Fifth, this bias profile can easily be modified by changing the shape of cam 66 and the stiffness of spring 64. Thus, numerous custom force profiles are possible. In addition, the force profile of the front pivoting roller assembly 50 might be configured differently from the back pivoting roller assembly 51.

Accordingly, it can be seen that the roller board brings a new freedom of movement to skateboarding, approximating many of the movements found in snowboarding. The roller board provides the ability to "carve," as a conventional skateboard can, where leaning weight to one side causes the device to turn in that direction. It permits a mode of omnidirectional motion, where the device can easily travel forwards, backwards, sideways or any combination thereof. It provides the ability to transition smoothly and controllably between the carving mode and the omnidirectional mode.

The roller board also provides a user interface that simulates the balance characteristics of snowboarding and other board sports, where the omnidirectional mode is engaged when the rider's weight is relatively evenly distributed across the board and this mode can be exited by transferring weight to the board's edge. It allows rotations of 180°, 360°, or more, repeatedly, without lifting or unweighting the board, while in motion over terrain. It includes a height adjustment means such that the relative ease of entering the omnidirectional mode can be increased or decreased according to the user's preference. It provides the ability to ride on a variety of terrains, including paved surfaces, grass and dirt. It enables the rider to slow down when necessary, by increasing the friction between fixed wheels 40 and the surface traveled over. Finally the roller board is relatively simple in its design and would be economical to produce and sell.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by examples given.

I claim:

1. A roller board comprising:

an integral, substantially rigid platform structure for supporting both feet of a user, the platform structure having a central longitudinal axis;

first and second longitudinally spaced wheel assemblies attached to an underside of the platform structure, each wheel assembly having a pair of spaced fixed wheels having a common axis of rotation coupled to fixed wheel mounting means oriented substantially transversely to the central longitudinal axis, the fixed wheel mounting means being configured to maintain the fixed wheels coupled thereto in axial alignment and being pivotable relative to the platform structure for steering the roller board upon tilting of the platform structure about the central longitudinal axis, each fixed wheel mounting means being biased for defining a direction of travel along the longitudinal axis when the platform structure is in a non-tilted orientation with the platform structure extending substantially parallel with a supporting surface;

at least two longitudinally spaced roller assemblies attached to the underside of the platform structure only along the central longitudinal axis, each roller assembly having at least one roller mounted for pivotal movement about a vertical axis, each roller assembly being configured to bias the associated roller into a first and a second pivotal position;

wherein a body weight of the user is supported primarily by the rollers when the platform is in the non-tilted orientation to permit movement of the roller board in a direction of travel extending along the longitudinal axis or transversely thereto; and wherein the user may selectively cause an increased portion of the body weight to be supported by ones of the fixed wheels of the first and second wheel assemblies to thereby permit steering of the roller board by pivotal movement of the fixed wheel mounting means relative to the platform structure upon tilting of the platform structure.

2. The roller board of claim 1, wherein the fixed wheel mounting means comprise an axle.

3. The roller board of claim 1, wherein each roller has a lowermost surface normally positioned lower than a lowermost surface of each of the fixed wheels.

4. The roller board of claim 3, wherein the position of the lowermost surfaces of the rollers is adjustable relative to the lowermost surfaces of the fixed wheels.

5. The roller board of claim 1, wherein the second pivotal position of the roller is angularly displaced by 180° from the first pivotal position.

6. A roller board comprising:

an integral, substantially rigid platform structure for supporting both feet of a user, the platform structure having a central longitudinal axis;

first and second longitudinally spaced wheel assemblies attached to an underside of the platform structure, each wheel assembly having a pair of spaced fixed wheels having a common axis of rotation coupled to fixed wheel mounting means oriented substantially transversely to the central longitudinal axis, the fixed wheel mounting means being configured to maintain the fixed wheels coupled thereto in axial alignment and being pivotable relative to the platform structure for steering the roller board upon tilting of the platform structure about the central longitudinal axis, each fixed wheel mounting means being biased for defining a direction of travel along the longitudinal axis when the platform structure is in a non-tilted orientation with the platform structure extending substantially parallel with a supporting surface;

at least two longitudinally spaced roller assemblies attached to the underside of the platform structure only along the central longitudinal axis and being positioned between the first and second wheel assemblies, each roller assembly having at least one roller mounted for pivotal movement about a vertical axis;

wherein a body weight of the user is supported primarily by the rollers when the platform is in the non-tilted orientation to permit movement of the roller board in a direction of travel extending along the longitudinal axis or transversely thereto; and wherein the user may selectively cause an increased portion of the body weight to be supported by ones of the fixed wheels of the first and second wheel assemblies to thereby permit steering of the roller board by pivotal movement of the fixed wheel mounting means relative to the platform structure upon tilting of the platform structure.

7. The roller board of claim 6, wherein the fixed wheel mounting means comprise an axle.

8. The roller board of claim 6, wherein each roller has a lowermost surface normally positioned lower than a lowermost surface of each of the fixed wheels.

9. The roller board of claim 8, wherein the position of the lowermost surfaces of the rollers is adjustable relative to the lowermost surfaces of the fixed wheels.

10. The roller board of claim 6, wherein each of the roller assemblies is configured to bias the associated roller into a first and a second pivotal position.

11. A roller board comprising:

an integral, substantially rigid platform structure having an upper surface for supporting thereon both feet of a user, the platform structure having a central longitudinal axis, the platform structure having a platform height defined by a vertical distance between a supporting surface and the upper surface when the platform structure is in a non-tilted orientation with the platform structure extending substantially parallel with the supporting surface;

first and second longitudinally spaced wheel assemblies attached to an underside of the platform structure, each wheel assembly having a pair of spaced fixed wheels having a common axis of rotation coupled to fixed wheel mounting means oriented substantially transversely to the central longitudinal axis, the fixed wheel mounting means being configured to maintain the fixed wheels coupled thereto in axial alignment and being pivotable relative to the platform structure for steering the roller board upon tilting of the platform structure about the central longitudinal axis, each fixed wheel mounting means being biased for defining a direction of travel along the longitudinal axis when the platform structure is in the non-tilted orientation;

each of the fixed wheels having a lateral outwardly directed surface, the distance between the outwardly directed surfaces of each pair of fixed wheels defining a wheel base width, the ratio of the platform height to the wheel base width being less than 0.40;

at least two longitudinally spaced roller assemblies attached to the underside of the platform structure only along the central longitudinal axis, each roller assembly having at least one roller mounted for pivotal movement about a vertical axis;

wherein a body weight of the user is supported primarily by the rollers when the platform is in the non-tilted orientation to permit movement of the roller board in a direction of travel extending along the longitudinal axis or transversely thereto; and wherein the user may selectively cause an increased portion of the body weight to be supported by ones of the fixed wheels of the first and second wheel assemblies to thereby permit steering of the roller board by pivotal movement of the fixed wheel mounting means relative to the platform structure upon tilting of the platform structure.

12. The roller board of claim 11, wherein the fixed wheel mounting means comprise an axle.

13. The roller board of claim 11, wherein each roller has a lowermost surface normally positioned lower than a lowermost surface of each of the fixed wheels.

14. The roller board of claim 13, wherein the position of the lowermost surfaces of the rollers is adjustable relative to the lowermost surfaces of the fixed wheels.

15. The roller board of claim 11, wherein each of the roller assemblies is configured to bias the associated roller into a first and a second pivotal position.

* * * * *